US005791812A

United States Patent [19]

Ivey

[11] Patent Number: 5,791,812

[45] Date of Patent: Aug. 11, 1998

[54] COLLISION PERFORMANCE SIDE IMPACT (AUTOMOBILE PENETRATION GUARD)

[75] Inventor: Don L. Ivey, Bryan, Tex.

[73] Assignee: The Texas A&M University System, College Station, Tex.

[21] Appl. No.: 729,182

[22] Filed: Oct. 11, 1996

[51] Int. Cl.[6] ..... E01F 13/00; E01F 15/00; E01F 9/00

[52] U.S. Cl. ..... 404/6; 404/9; 404/10; 256/13.1

[58] Field of Search ..... 404/6, 9, 10; 256/1, 256/13.1

[56] References Cited

U.S. PATENT DOCUMENTS

| | | | |
|---|---|---|---|
| 2,154,818 | 4/1939 | Mayer | 256/13.1 |
| 2,776,116 | 1/1957 | Brickman | 256/13.1 |
| 3,643,924 | 2/1972 | Fitch | 256/13.1 |
| 3,661,359 | 5/1972 | Walker | 256/1 |
| 3,690,619 | 9/1972 | Kendall | 256/13.1 |
| 4,655,434 | 4/1987 | Bronstad | 256/13.1 |
| 4,674,911 | 6/1987 | Gertz | 404/6 |
| 4,678,166 | 7/1987 | Bronstad et al. | 256/13.1 |
| 4,815,565 | 3/1989 | Sicking et al. | 188/32 |
| 4,928,928 | 5/1990 | Buth et al. | 256/13.1 |
| 5,022,782 | 6/1991 | Gertz et al. | 404/6 |
| 5,078,366 | 1/1992 | Sicking et al. | 256/13.1 |
| 5,112,028 | 5/1992 | Laturner | 256/13.1 |
| 5,391,016 | 2/1995 | Ivey et al. | 404/6 |
| 5,407,298 | 4/1995 | Sicking et al. | 404/6 |
| 5,490,661 | 2/1996 | Stevens et al. | 256/13.1 |

FOREIGN PATENT DOCUMENTS

| | | |
|---|---|---|
| 094846 | 11/1983 | European Pat. Off. . |
| 2651811 | 5/1969 | France . |
| 1295582 | 3/1991 | Germany . |

OTHER PUBLICATIONS

An End Treratment for Concrete Barriers Used in Work Zones; Texas Transportation Institute State Department of Highways and PUblic Transportation; Research Report 262–2; Aug. 1982 (Rev. 02–83) (19 pp.).

A Guide to Standardized Highway Barrier Hardware; AASHTO–AGC–ARTBA Joint Committee; Subcommittee on New Highway Materials, Tash Force 13 Report; (undated) (17p.).

Colorado Median Barrier End Treatment Tests; R. G. Robertson and H. E. Ross, Jr.; May 1981; (15 pp.).

*Primary Examiner*—Tamara L. Graysay
*Assistant Examiner*—Gary S. Hartmann
*Attorney, Agent, or Firm*—Conley, Rose & Tayon, P.C.

[57] ABSTRACT

Apparatus and methods are described for preventing the penetration of vehicles by narrow objects such as guardrail ends or portions of a guardrail end treatment during a collision. In one embodiment, portions of an ET-2000 guardrail extruder terminal are adapted for improved operation during impacts by attachment of a penetration guard. The penetration guard may also be affixed to other guardrail end treatments or even other suitable highway objects to create an improved safety apparatus. The penetration guard includes a frame and is affixed to the impact head of an ET-2000 guardrail extruder terminal. The frame is greatly collapsible when impacted from a substantially end-on direction. However, when impacted from a direction other than substantially end-on, the frame is substantially non-collapsible and maintains its integrity. The frame includes an outer housing which defines a central opening. The housing is preferably formed of a unitary outer of sheet metal which surrounds the central opening. In alternative embodiments, the housing is made up of a number of hingedly affixed plates or panels or deformable members which collectively change shape in a predetermined manner. In some embodiments, the frame includes an interior brace which helps prevent collapse of the frame when the frame is impacted from its side. If desired, the central opening may be filled with an appropriate energy absorbing deformable filler material.

20 Claims, 10 Drawing Sheets

FIG. 14A
( Prior Art )
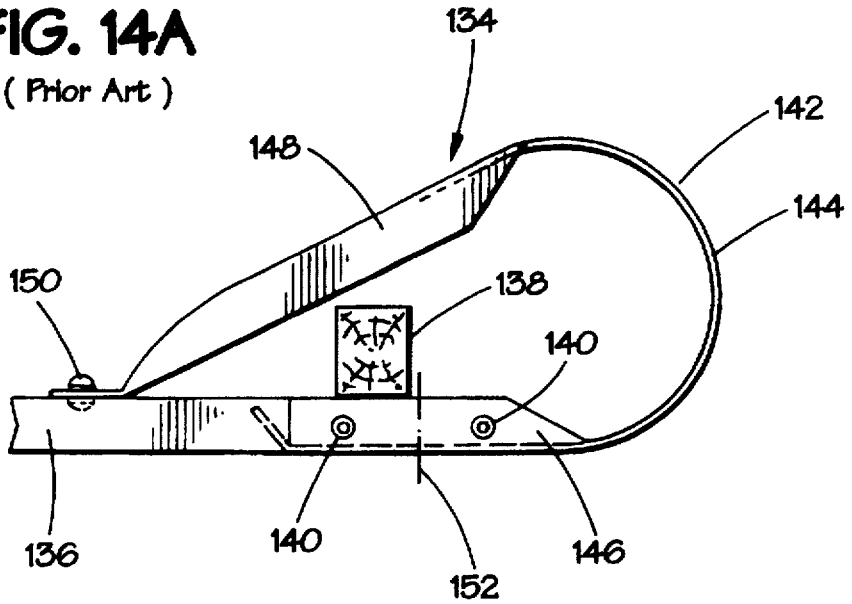
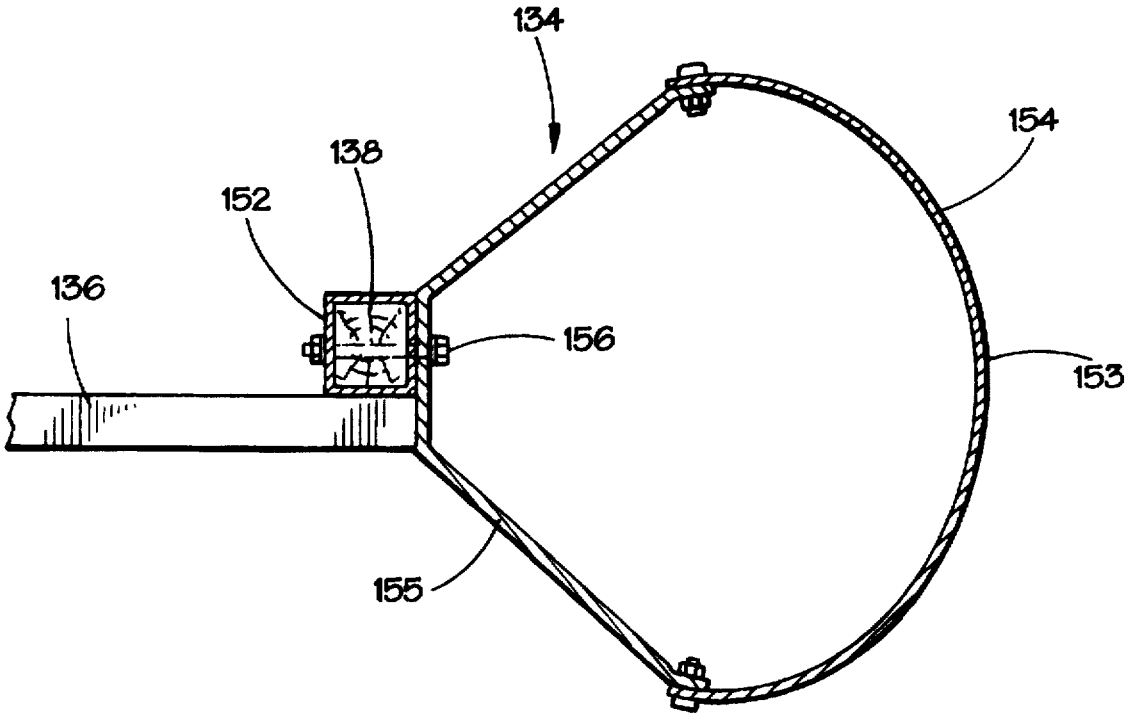
FIG. 14B

COLLISION PERFORMANCE SIDE IMPACT (AUTOMOBILE PENETRATION GUARD)

BACKGROUND OF THE INVENTION

1. Field of the Invention

The present invention relates to methods and apparatus for improved safety for end treatments on roadway guardrails and other appurtenances. In one particular aspect, the present invention features a modification of the ET-2000 safety device.

2. Description Of Related Art

Guardrails present a unique fixed object safety problem due to the raised ends which they sometimes present. Therefore, a number of guardrail end treatments have been developed which attempt to reduce the hazard presented by the raised ends. Guardrail end treatments seek to reduce the harmful effects of collisions with the ends of guardrails by absorbing, redirecting or cushioning impacts with the end of the rail. One such end treatment is the Slotted Rail Terminal (SRT) which is described in U.S. Pat. No. 5,407,298 by Sicking et al. and assigned to the assignee of the present invention. That patent is incorporated herein by reference. Another example is the Eccentric Loader Guardrail Terminal or Modified Eccentric Loader Terminal (MELT) described, for example, in U.S. Pat. No. 4,678,166, issued to Bronstad et al. also incorporated herein by reference.

The Breakaway Cable Terminal (BCT) end treatment is one of the most widely used guardrail end treatments in the United States. It has been a well known end treatment for many years. Another guardrail end treatment, known commercially as ET-2000 or as the Guardrail Extruder Terminal, has been in use for several years as an end treatment for the end of a W-shaped beam member guardrail. The ET-2000 serves to attenuate impacts with the end of the guardrail and provides anchorage for impacts to the sides of the guardrail. In an end-on impact, the ET-2000 progressively flattens the beam of the guardrail and bends the flattened member in a curvilinear arc in a direction away from the colliding vehicle. Aspects of the ET-2000 have been described and claimed in U.S. Pat. No. 4,928,928, entitled "Guardrail Extruder Terminal," issued to Buth et al. on May 29, 1990, and U.S. Pat. No. 5,078,366, entitled "Guardrail Extruder Terminal," issued to Sicking et al. on Jan. 7, 1992. Both of these patents have been assigned to the assignee of the present invention and are incorporated herein by reference. The ET-2000 and the SRT are available commercially from Trinity Industries in Dallas, Texas.

It has been noted that the ET-2000, as well as all other end treatments known to the inventor, have the potential to puncture the passenger compartment a colliding vehicle if the vehicle is turned sideways prior to impacting the end of a guardrail. As a vehicle is stopped, the vehicle structure must overcome the inertia of the ET-2000 head and the force needed to begin flattening and bending the W-beam rail. If the vehicle impacts the ET-2000 head with its front, the portions of the vehicle can deform for approximately two feet before the passenger compartment will be punctured by the ET-2000 head or elements within the front compartment, such as the engine, which are pushed toward the passenger compartment by the ET-2000 head.

The passenger doors, however, present a point of vulnerability for vehicle passengers. The front passenger doors are located between the "A" and "B" door pillars which frame the vehicle doorways. The location and arrangement of these pillars will be shown and described shortly with reference to FIGS. 13 and 14. These pillars are relatively strong structurally supporting members of the vehicle's roof. The "A" pillar, for instance, on the driver's side of the vehicle is located at the left front corner of the passenger compartment along the forward edge of the doorway and generally runs from the vehicle roof to its floor frame. The "B" pillar on the driver's side of the vehicle is located toward the left rear corner of the front passenger compartment and also generally runs from the vehicle roof to the floor frame. The space between the "A" and "B" pillars on a vehicle is typically 40–50 inches.

When a vehicle impacts an ET-2000 device, or other guardrail end treatment, such as an SRT, MELT or BCT, the impact head of the end treatment may generally fit easily within the gap between the "A" and "B" pillars, thereby often permitting penetration of the passenger compartment of the vehicle by the impact head. Simply padding the impact head will not prevent penetration of the compartment. Making an extremely wide head is generally impractical and might serve to block vision or distract drivers.

Generic crash cushions have been developed in the prior art. One example is that described in U.S. Pat. No. 3,643,924, "Highway Safety Device" issued to Fitch. Devices such as this do serve the purpose of attenuating impact during a vehicle collision primarily by the "conservation of momentum" principle which is why they are filled to varying degrees with sand. Such a device is simply a guardrail wrapped around sand-filled cylinders. This arrangement was not designed to prevent injury in side impact collisions, nor is it designed to be affixed to an object such as a guardrail end or an ET-2000 device.

SUMMARY OF THE INVENTION

The present invention offers methods and apparatus for preventing penetration of vehicles by narrow objects such as guardrail ends or portions of a guardrail end treatment during a collision. The present invention has particular application to fixed objects which tend to present an impaling hazard to vehicles, such as guardrails and some highway median barriers. In one preferred embodiment of the invention, an ET-2000 guardrail end treatment is adapted for improved operation during impacts by attachment of a Collision Performance Side Impact (CPSI) automobile penetration guard. The apparatus may also be affixed to other guardrail end treatments or other suitable items which might be impacted during a highway collision in order to improve their safety by reducing the initial velocity changes and lowering the peak impact forces that result in penetration of the vehicle and violation of the passenger compartment.

In one exemplary embodiment, the invention features a penetration guard which comprises a frame which is affixed to the impact head of an ET-2000 guardrail extruder terminal or other roadway object. The frame is designed to be greatly collapsible when impacted from a substantially end-on direction. However, when impacted from a direction other than substantially end-on, such as a glancing impact direction, the frame is substantially non-collapsible and maintains its integrity. The frame includes an outer housing which defines a central opening. In one embodiment, the housing is formed of a unitary outer of sheet metal which surrounds the central opening. In alternative embodiments for the penetration guard, the housing is made up of a number of hingedly affixed plates or corrugated panels or deformable members which collectively change shape in a predetermined manner. In some embodiments, the frame includes an interior brace which helps prevent collapse of the frame when the frame is impacted from its side. If desired, the central opening may be filled with an appropriate energy-absorbing or deformable filler material. A penetration guard is also combinable with alternative guardrail end treatments, such as the BCT, SRT and MELT to create improved safety apparatus.

BRIEF DESCRIPTION OF THE DRAWINGS

FIG. 14A is a plan view of a prior art BCT end treatment.

FIG. 14B is a plan view of a BCT end treatment having been modified to incorporate an exemplary penetration guard.

DETAILED DESCRIPTION OF THE PREFERRED EMBODIMENTS

The methods and apparatus of the present invention have been developed for and are primarily directed toward use with ET-2000 type guardrail end treatments. However, the invention has application to numerous other guardrail end treatments and other roadway objects which present similar hazards to motorists.

In accordance with the present invention, exemplary CPSI penetration guard arrangements are described in which a frame is provided which spreads the impact load over a much larger area of the structure of an impacting vehicle. The combination of the penetration guard and the guardrail end treatment results in a more effective safety apparatus. The frame collapses over a short distance in a relatively controlled manner at a low collapse load and over an expanded area, preventing penetration of the door. The disadvantage of a wider end being more susceptible to vehicle glancing impacts is more than countered by the increased visibility of the wider end and the damage reduction from glancing impacts due to the lateral stability of CPSI.

Also, the progressively rising load due to the controlled structural deformation of the frame also acts to accelerate a guardrail head or end over a much larger period of time, thus significantly reducing the inertia load on the vehicle caused by the rail end. In the described embodiments, the frame of the penetration guard is adapted to readily collapse in an end-on impact while substantially maintaining its structural integrity during an impact along the side of the frame.

Figure 1:
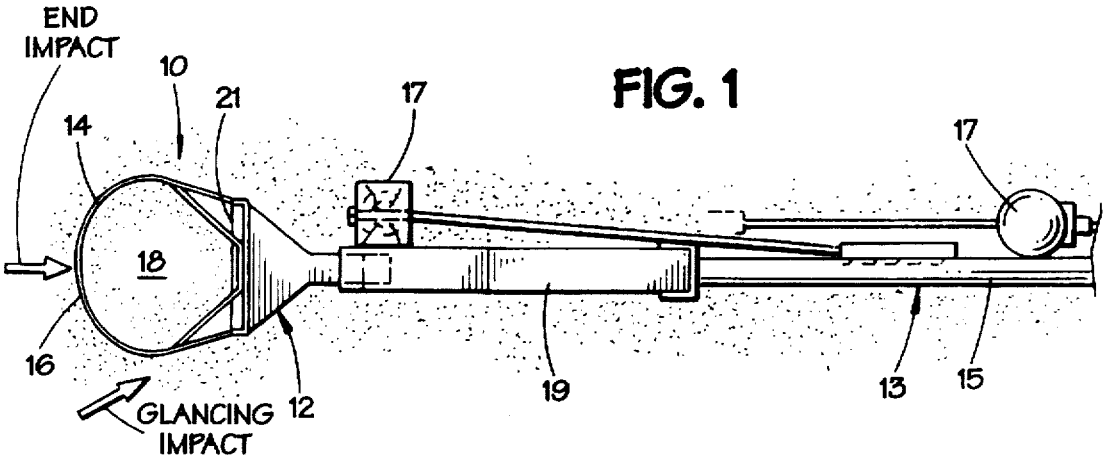
FIG. 1 is a plan view of an exemplary guardrail end equipped with an ET-2000 device which incorporates a penetration guard constructed in accordance with a preferred embodiment of the invention.
Figure 2:
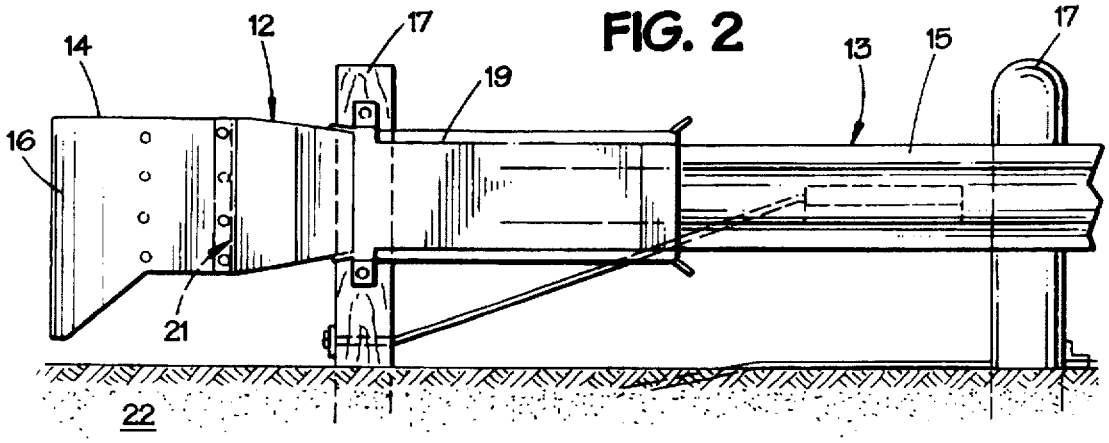
FIG. 2 is a side view of the guardrail end of FIG. 1.
Figure 3:
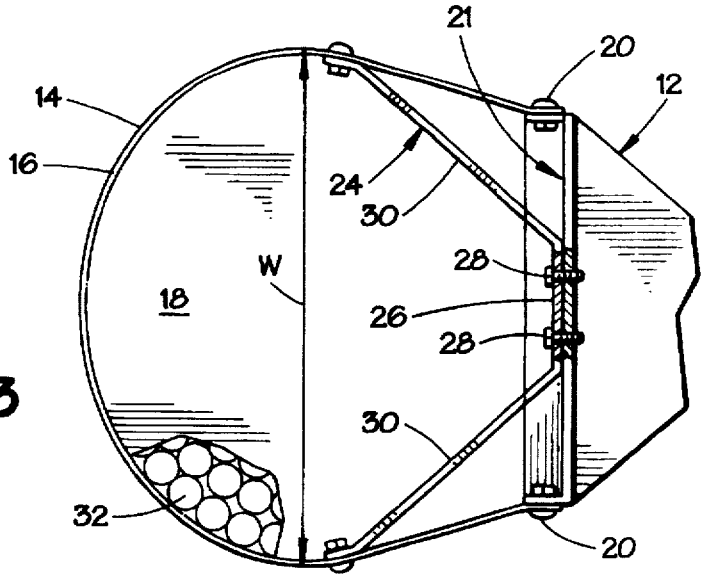
FIG. 3 and 4 are closer views of the penetration guard of FIGS. 1 and 2, FIG. 4 being a partial cutaway
Figure 4:
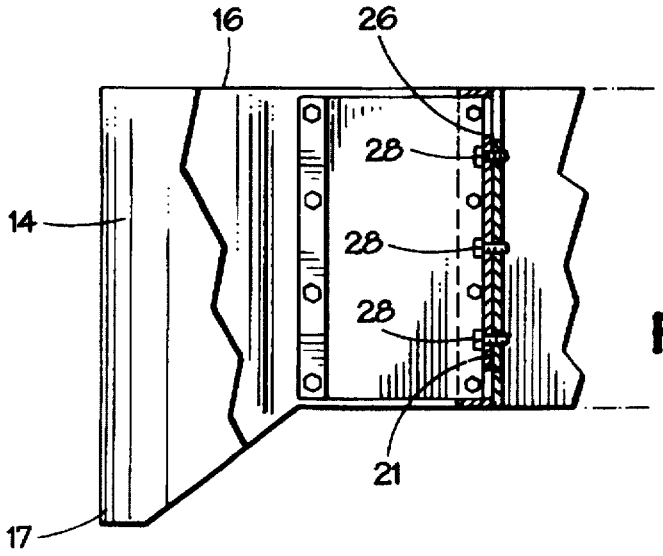
Figure 5:
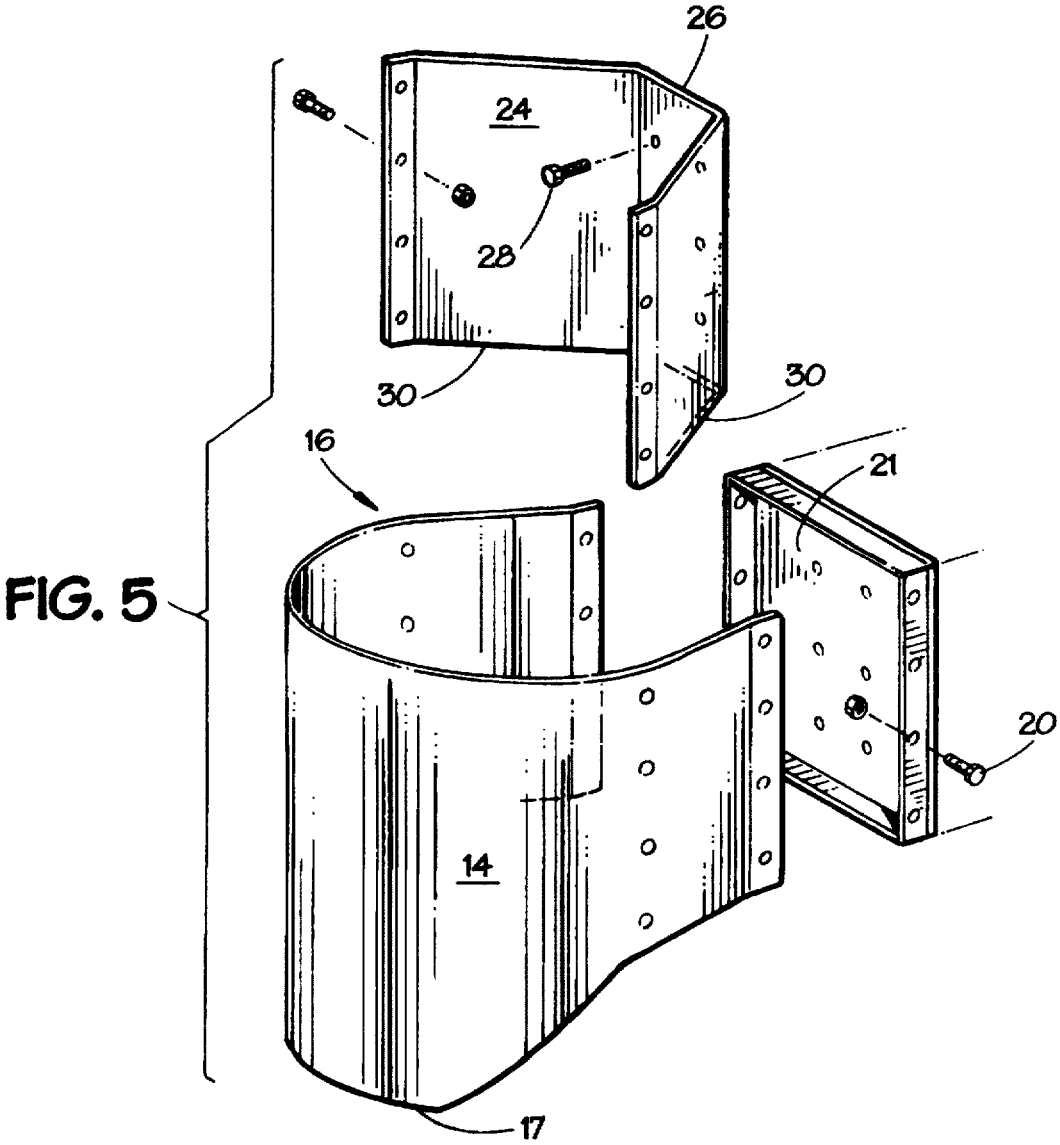
FIG. 5 is an exploded view of the penetration guard shown in FIGS. 3 and 4.

Referring first to FIGS. 1 and 2, a preferred exemplary penetration guard 10 is shown affixed to an ET-2000 device 12 which has been installed onto a guardrail installation 13 along a roadway (not shown). The guardrail 13 includes a horizontal rail 15 mounted upon one or more support posts 17. The ET-2000 device 12 includes a feeder chute 19 and a front striking plate 21. Referring now as well to FIGS. 3–5, the penetration guard 10 includes a collapsible frame 14 which includes a unitary sheet metal shell 16. The sheet metal is preferably of #10 gage material, however, other suitable thicknesses or gages may be used. The sheet metal shell 16 is bent or formed to surround a central opening 18. The shell 16 is then affixed to the impact head of an ET-2000 12 by means of suitable connectors 20. It is presently preferred that the connectors 20 comprise a headless, or round-head, bolt and nut arrangement as the headless nature of the round head bolt presents a smooth appearance and reduces the number of sharp edges or protrusions. It is also preferred that the shell 16 be formed so that at least a portion 17 extends downwardly toward the ground 22.

The frame 14 also includes a brace piece 24. The brace piece 24 is preferably formed of ¼" steel plate or plate sections, but other suitable plate thicknesses and materials may be used. The brace piece 24 is generally fashioned to be sturdier than the shell 16, which is made of sheet metal. The brace piece 24 is made up of a central attachment section 26 through which connectors 28 are disposed to affix the brace piece 24 to the ET-2000 device 12. Two wing braces 30 extend laterally from the central attachment section 26 and are affixed at their opposite ends to portions of the sheet metal shell 16. The brace piece 24 provides some support to the frame 14 against premature collapse and, because the frame 14 is sturdier than the shell 16, it provides lateral support if the frame 14 is impacted upon its longitudinal side as would occur if there is a grazing or glancing impact of the terminal by a vehicle. This would occur when a vehicle approaches the frame 14 substantially from a direction such as that illustrated by the arrow labeled "Glancing Impact" in FIG. 1. However, if the frame 14 is impacted substantially from the end, as indicated by the FIG. 1 arrow labeled "End Impact," the frame 14 should readily collapse in a manner which will be described.

Figure 10:
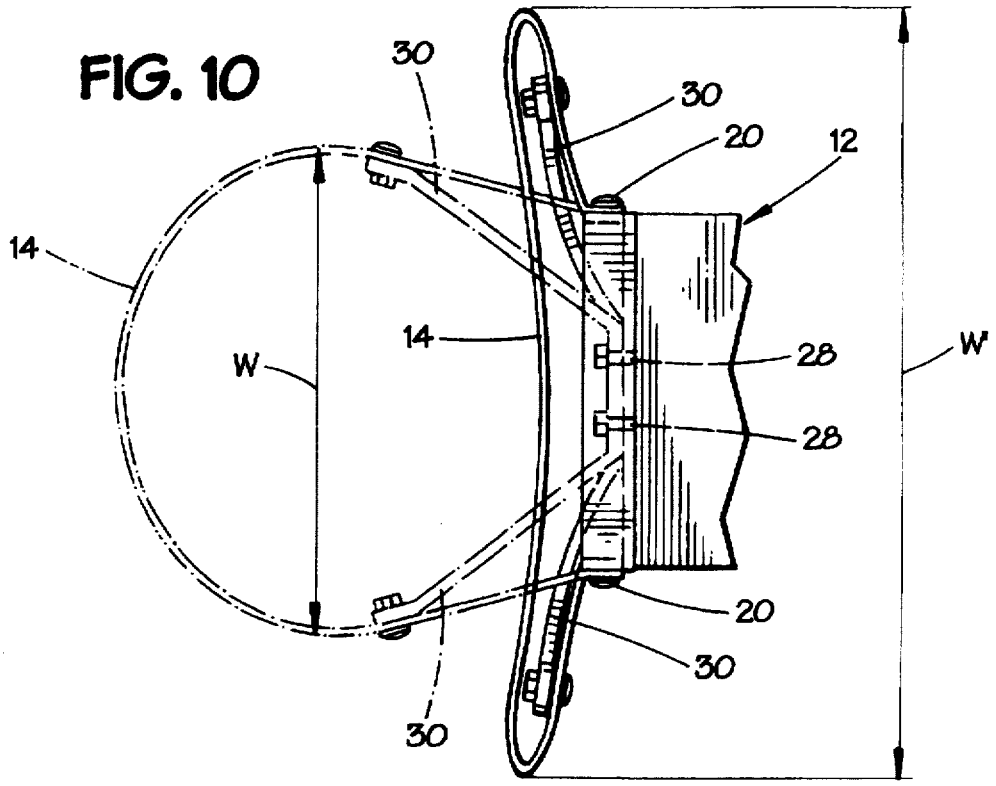
FIG. 10 is a plan view of the penetration guard of FIGS. 1 and 4 after impact with a vehicle.

Upon an end impact, the penetration guard 10 will deform so as to expand laterally outward forming a wide barrier to penetration of the doorway by the object, as depicted in FIG. 10. Prior to impact, the penetration guard 10 presents an end-on impact area of reduced width or "w" in FIG. 1. A preferred range of reduced widths "w" is generally from approximately 2 feet to approximately 4 feet. A particularly preferred reduced width "w" is approximately 2 ½ feet.

During an end-on collision, the frame 14 of the penetration guard deforms so that a second end-on impact area of greater width, "w" in FIG. 10, is provided. The width of the second expanded impact area, "w" approaches and may exceed the width of space between the "A" and "B" door pillars for a vehicle. Preferably, the width of the second expanded area is about four feet.

If desired, the central opening 18 may be filled with a readily deformable, energy-absorbent material or member such as aluminum cans 32, partially shown in FIG. 3. Alternative filler materials or members include styrofoam peanuts and ultra low strength concrete.

Figure 6:
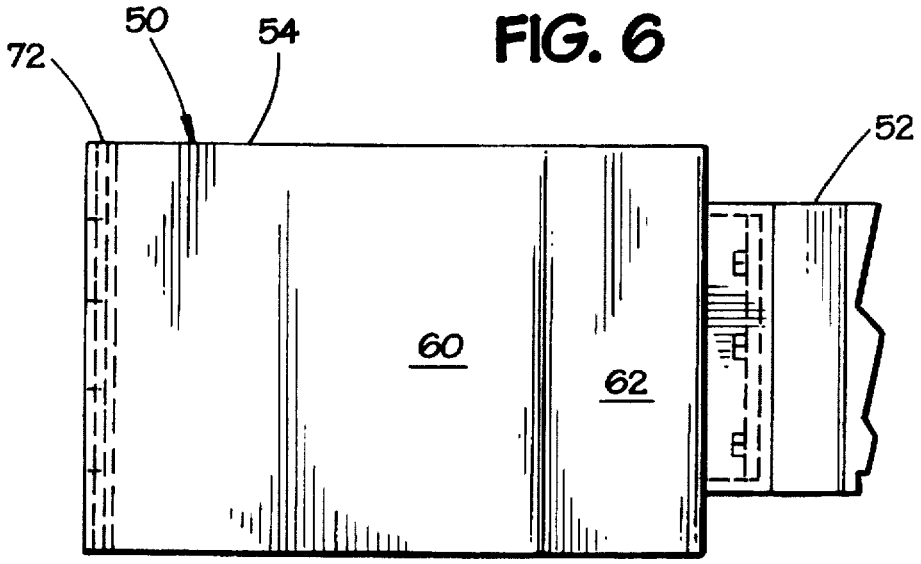
FIG. 6 is a side view of an alternative embodiment of a penetration guard incorporating substantially flat panels of plate or plate sections.
Figure 7:
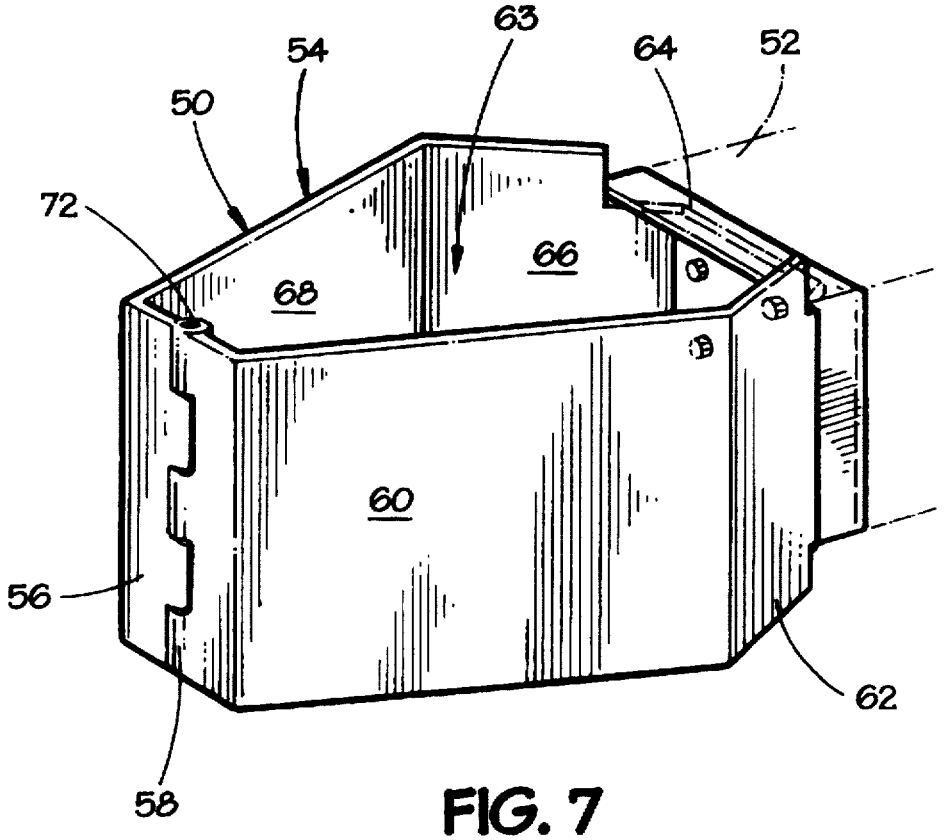
FIG. 7 is an isometric view of the penetration guard of FIG. 6.
Figure 12:
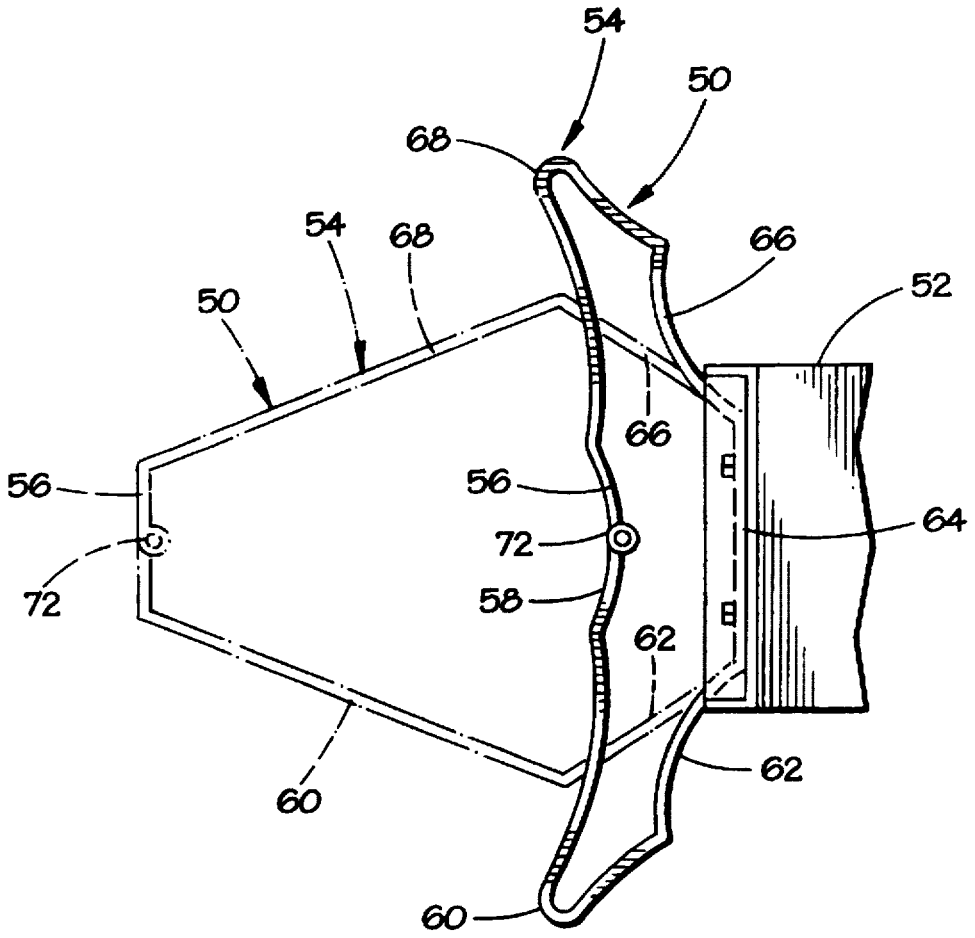
FIG. 12 is a plan view of the penetration guard of FIGS. 6–7 after impact.

A second embodiment of the penetration guard of the present invention is depicted in FIGS. 6–7 and 12. In this embodiment, the penetration guard 50 is similarly affixed to the impact head of an ET-2000 device 52. The frame 54 of the penetration guard 50 is constructed of a number of plates or plate sections 56, 58, 60, 62, 64, 66 and 68. These plates or plate sections are less than ½" in thickness. A preferred range of thickness is ⅛"–¼". The plates surround a central opening 63. The plates are hinged with a suitably sized pin or connector, such as a ¾" pin 72, at the upstream end of the frame 54 to assist inward collapse of the frame 54 in an end-on impact. The construction of welds and an upstream pivot point permits the frame 54 to retain structural integrity during an impact from the side of the frame while readily collapsing during an end-on impact. FIG. 12 shows the penetration guard 50 after an end-on impact with a vehicle (not shown). As with the first embodiment, the frame 54 deforms so that a second end-on impact area of greater width is provided.

A low-density crushable concrete insert (not shown) may be used as a filler as well. Low-density crushable concrete members are described in U.S. Pat. No. 4,909,661 issued to Ivey which is assigned to the assignee of the present invention and incorporated herein by reference. The crushable concrete insert would be cast in or cut to a suitable shape to fit within the central opening 68. Use of a crushable concrete insert as filler is recommended primarily for use with the second embodiment of CPSI penetration guard which is described and shown in FIGS. 6, 7 and 12. It is noted that, in most instances, use of such filler will not be necessary.

Figure 8:
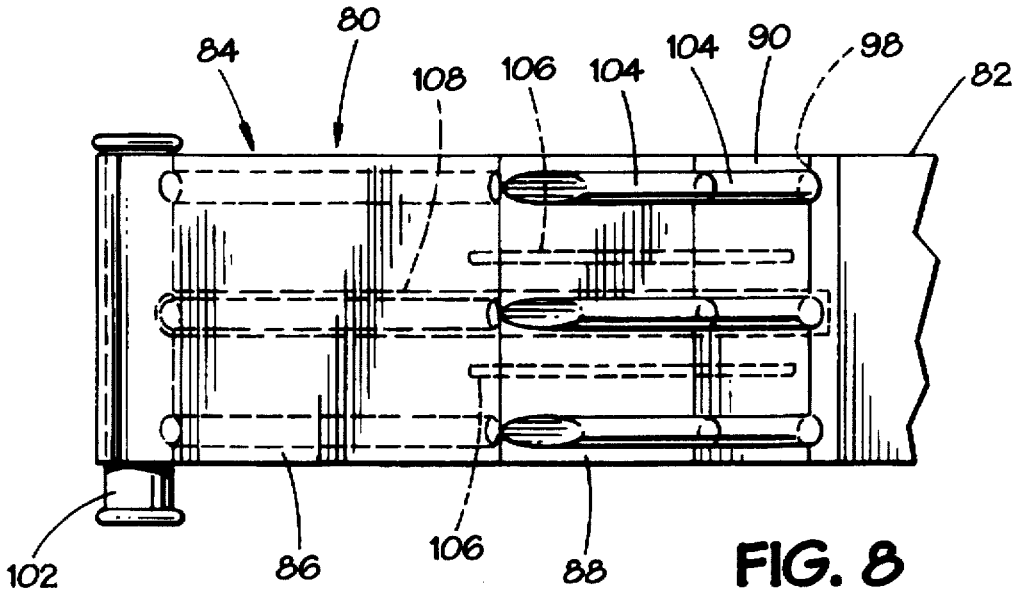
FIG. 8 is a side view of a third embodiment of the penetration guard incorporating reinforced panels.
Figure 9:
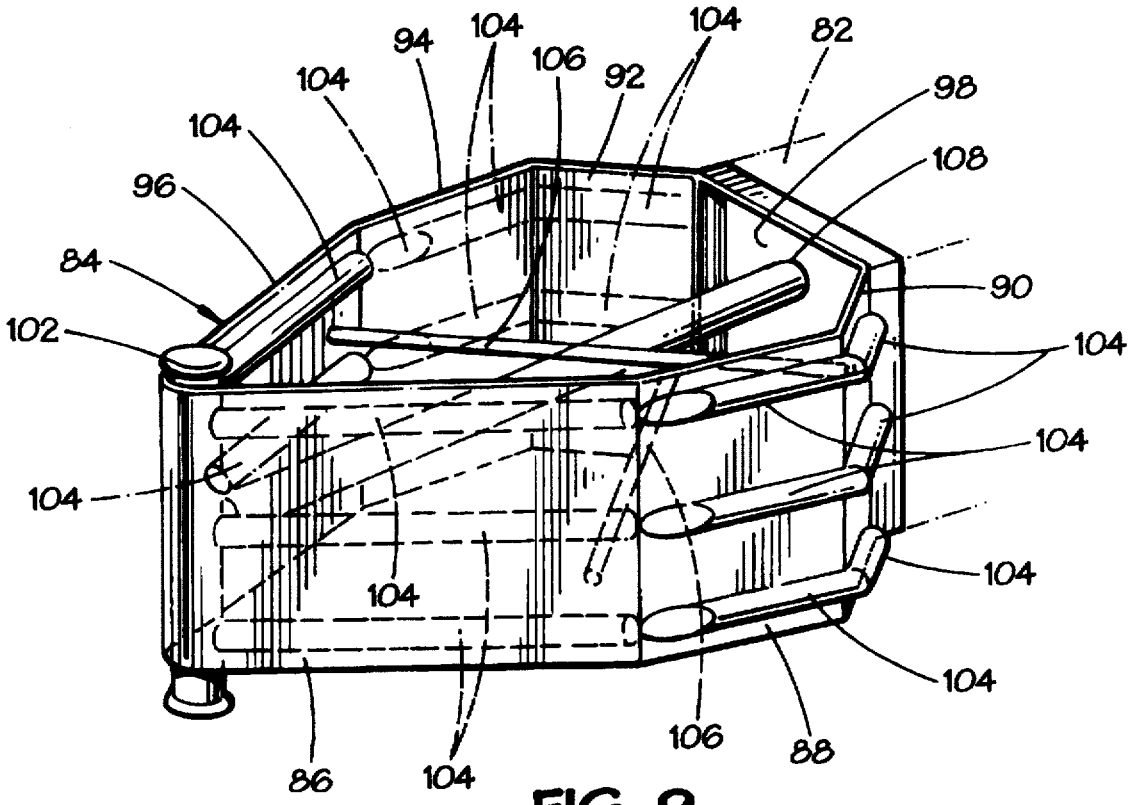
FIG. 9 is an isometric view of the penetration guard of FIG. 8.
Figure 11:
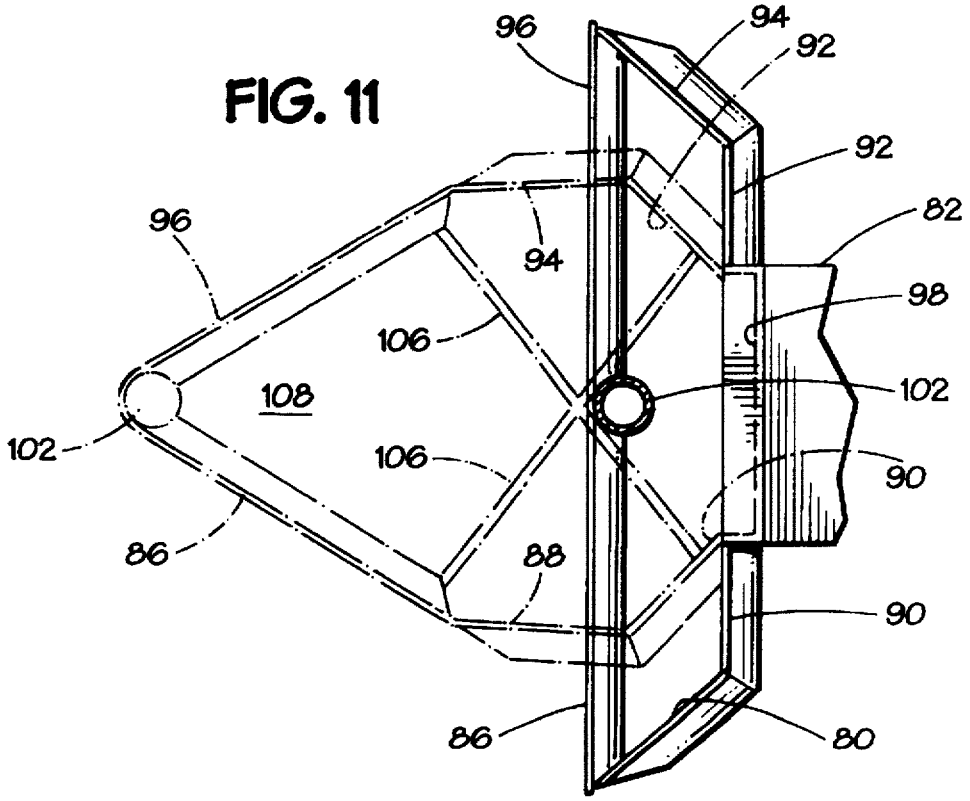
FIG. 11 is a plan view of the penetration guard of FIGS. 8–9 after impact.

A third embodiment of the penetration guard of the present invention is shown in FIGS. 8–9 and 11. Penetration guard 80 is affixed to the impact head of an ET-2000 device 82. The frame 84 of the penetration guard 80 is fashioned from a plurality of reinforced metal panels 86, 88, 90, 92, 94 and 96 which are affixed to one another by welding. The panels 88, 90, 92, 94, 96 may be either flat or corrugated. In this embodiment depicted in FIGS. 8–9 and 11, these panels are flat metal panels of the same thickness as that of the plates 56, 58, 60, 62, 64, 66 and 68. The frame 84 also includes a plate 98 by which the frame 84 is affixed to the impact head 82. At the upstream end of the frame 84 is a vertical pipe segment 102. The pipe segment 102 provides vertical stiffness to the frame 84 and extends low enough toward the ground to be able to engage low frame members of impacting vehicles. Horizontal pipe segments 104 are welded to the panels 86, 88, 90, 92, 94 and 96 to provide additional strength to the frame 84. Also, cross bracing 106 is provided within the opening 108 defined by the frame 84. Preferably, the cross-bracing 106 is made of steel pipe. Preferably also, the cross-bracing 106 is not fixedly attached to portions of the frame 84. Instead, the bracing 106 should be supported upon corrugations in the panels or upon the pipe segments 104 or otherwise placed so that it will lend strength to the frame 84 during an impact from the side. An alternative method for placement of the cross-bracing within the opening 108 would be to dispose the ends of the pipe segments onto short cylindrical metal rod segments which are welded at their other ends to the frame 84. The cylindrical metal rod segments would have a diameter less than the interior diameter of the pipe segment so that the rod segment could be easily inserted into the pipe segment. In an end-on impact, however, the bracing 106 will fall from the frame 84 as the width of the frame expands (see FIG. 11).

Also shown in FIGS. 8 and 9 is a preferred crushable energy-absorbing insert 108. A 4" diameter crushable tubular member such as the Extren Series 500 fiberglass reinforcing plastic structural shape available from Imco Reinforced Plastics, Inc., P.O. Box 534, 858 N. Lenola Road, Moorestown, N.J. 08057. Such members are disposed longitudinally or parallel to the guardrail upon which the ET-2000 device 82 is mounted. The insert 108 is preferably placed in between the cross-bracing member 106 (as shown) or above or below the cross-bracing members 106. Use of a crushable tubular member of this nature as filler is recommended primarily for use with the third embodiment of CPSI penetration guard which is described and shown in FIGS. 8, 9 and 11.

Figure 13A:
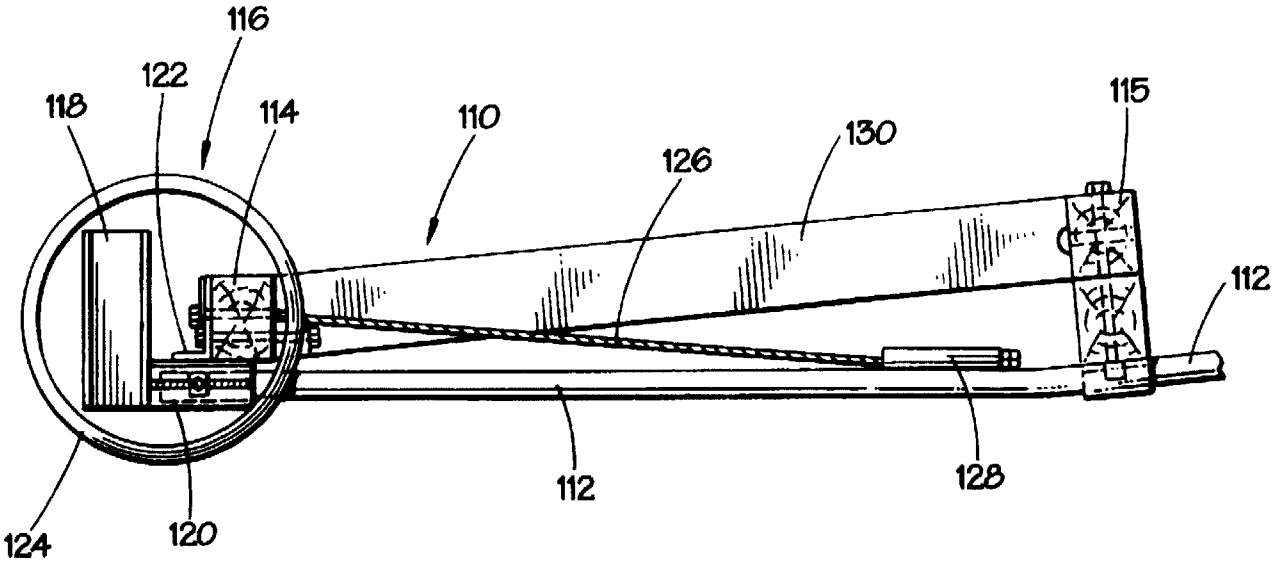
FIG. 13A (Prior Art)
FIG. 13A is a plan view of a prior art modified eccentric loader terminal melt end treatment.
Figure 13B:
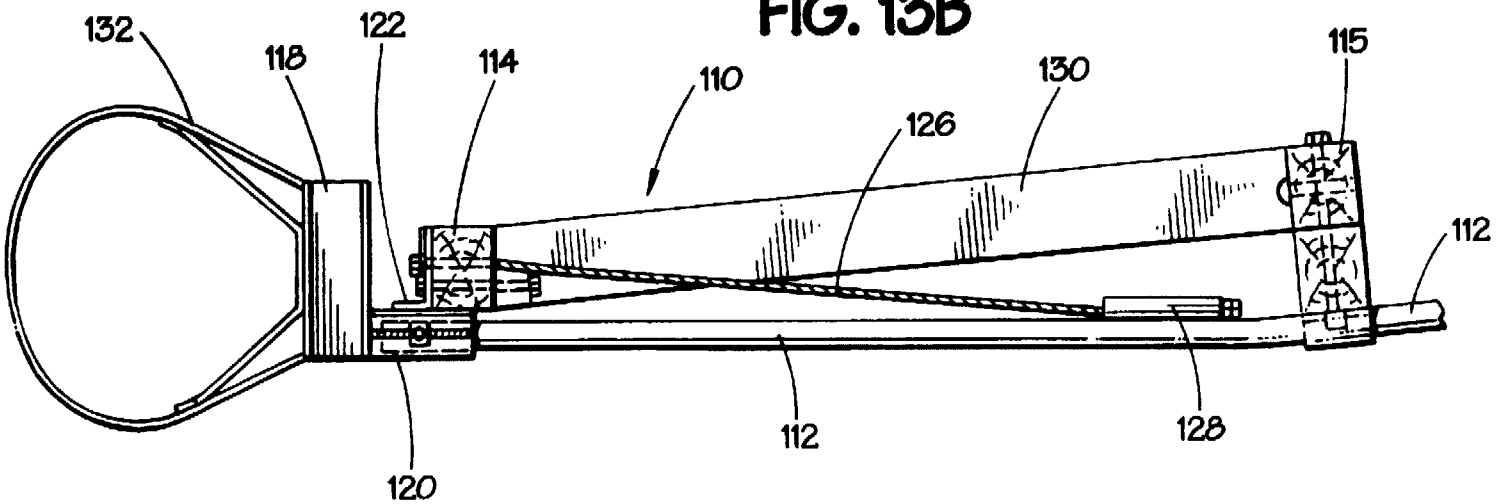
FIG. 13B depicts a melt end treatment which has been modified in accordance with the present invention to incorporate an exemplary penetration guard.

Referring now to FIGS. 13A and 13B as well as 14A, 14B and 14C, alternative embodiments are depicted in which a CPSI penetration guard is affixed to alternative guardrail end treatments. FIG. 13A is a plan view depicting a MELT or eccentric loader terminal 110 of the prior art which is constructed at the end of a conventional W-beam guardrail 112. As noted earlier, structure and operation of guardrail end treatments such as this is described in greater detail in, for example, U.S. Pat. No. 4,678,166 issued to Bronstad et al. The guardrails 112 are provided with a plurality of vertical supports 114 of any suitable number for vertically supporting the W-beam guardrail 112. An eccentric lever, generally indicated by the reference numeral 116, is provided at the upstream end. The eccentric lever 116 includes a plurality of metal beams such as H-beams 118, which are secured to a beam box 120, such as by welding, which is, in turn, connected to an angle iron 122 which is bolted to the furthest upstream support post 114. Enclosing the beams 118, the top of the support 114 and the end of the W-beam rail 112 is a tubular member 124, such as a corrugated portion of a metal culvert. The tubular member 124 is supported by being bolted to the support 114. A conventional anchor cable 126 is provided connected to the furthest upstream post 114 and to a connection 128 to provide tensile forces to redirect impacting vehicles downstream from the upstream end. A strut 130 is provided between the steel tube foundations (not shown) of posts 114 so that the strut 130 acts along with cable 126 to resist cable loads caused by impacts downstream of the attachment 128. The tubular member 124 is generally intended to prevent snagging of an impacting vehicle with beams 118 and, to a limited degree, serve as a barrier for the end of the rail 112. However, the tubular member 124 may be insufficient as a barrier and, thus, permit penetration of the passenger compartment by portions of the beams 118 in a side impact.

FIG. 13B depicts the eccentric loader terminal arrangement 110 after having been modified in accordance with the invention to incorporate a CPSI penetration guard 132. The tubular member 124 has been removed and a penetration guard assembly 132 has been attached to one or more of the beams 118 by bolting, welding or similar means. The penetration guard assembly 132 shown is of the type depicted in FIGS. 1–5. However, alternative designs may be used as well.

FIG. 14A depicts a plan view of one end of an exemplary guardrail assembly end 134 which incorporates a conventional BCT end treatment. Although such end treatments are well known in the art, it is pointed out that further details regarding their construction are available from publications such as "A Guide to Standardized Highway Barrier Hardware," Task Force 13 Report, AASHTO-ABC-ARATBA Joint Committee, Subcommittee on New Highway Material. The guardrail assembly end 134 includes a corrugated rail 136 such as a W-section rail which is supported by a number of support posts of which only the furthest upstream is depicted at 138. The W-section rail 136 is affixed by means of splice bolts 140 to a curved end member 142 which features a central flattened curved section 144 and a pair of straightened corrugated end sections 146, 148. The corrugated end section 148 is affixed by one or more bolts 150 to the W-section rail 136.

In order to modify the BCT end 134 for attachment of a CPSI penetration guard, bolts 150 and 149 are removed so that the curved end section 142 may be removed from the end 134. Portions of the W-section rail 136 which then extend upstream past the end of support member 138 must then be cut or sectioned away. The point of sectioning is indicated at line 152. Preferably, a rectangular hollow steel tube 152 is then affixed by two ½" diameter bolts 156 of suitable length disposed through the upper end of support post 138 and tube 152. It will be necessary to first detach the corrugated member 136 from support 138 in order to add the tube 152. This is done by removal of bolt-and-nut arrangement 157 visible in FIG. 15C. The corrugated member 136 is then reattached. A CPSI penetration guard 154 may then be affixed to the support member and steel tube 152 by means of bolts 156. The top bolt is preferably disposed approximately 3" from the top of the cap 152. The bottom bolt is disposed approximately 3" from the bottom of the cap 152. The penetration guard 154 includes a shell section 153 and a brace 155.

Figure 14C:
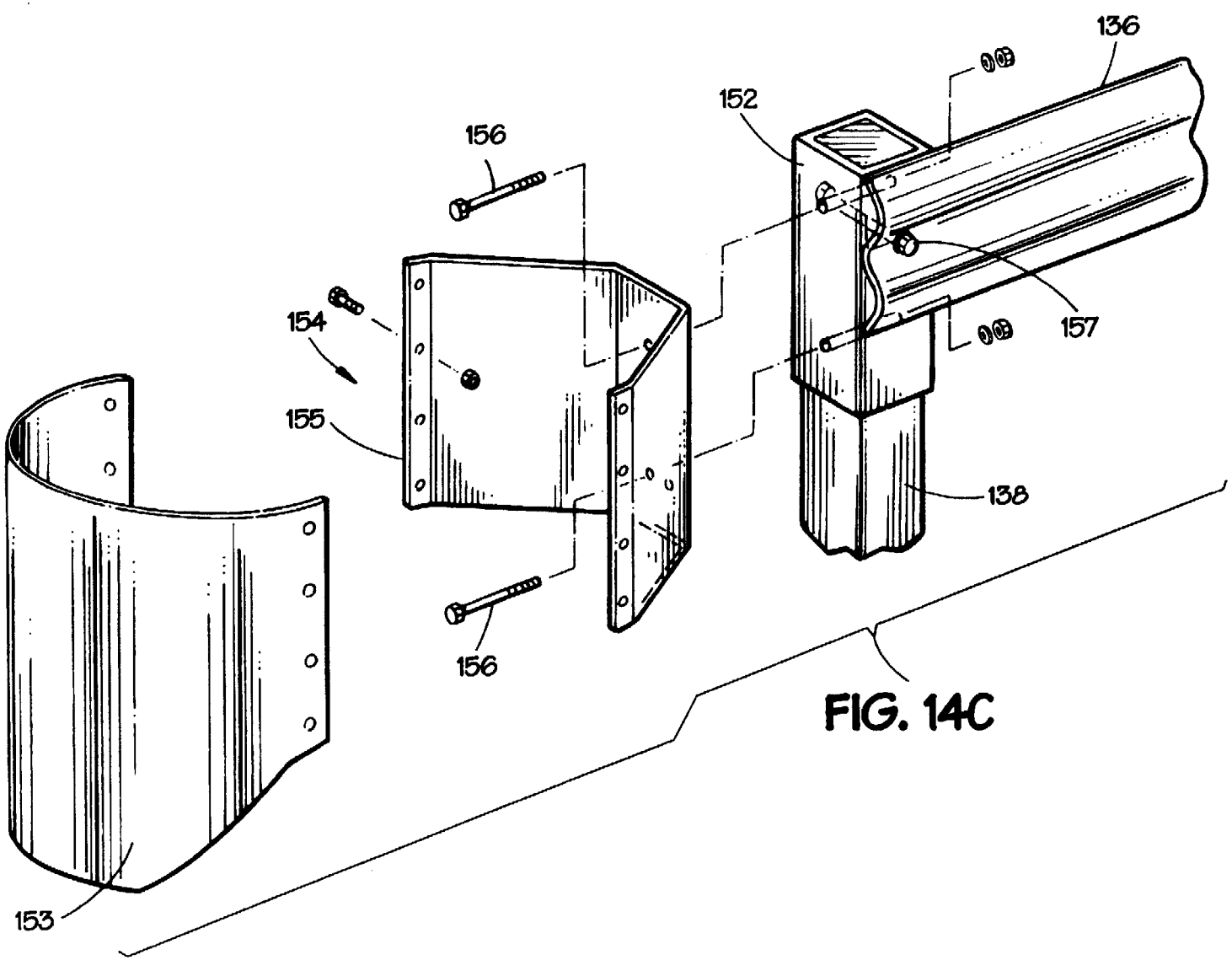
FIG. 14C is an isometric, exploded view of the modified BCT end treatment in FIG. 14B.

A method of attachment identical or similar to that described with respect to FIGS. 14A–14C would be appropriate for affixing a CPSI penetration guard to an SRT end treatment as well.

Figure 15:
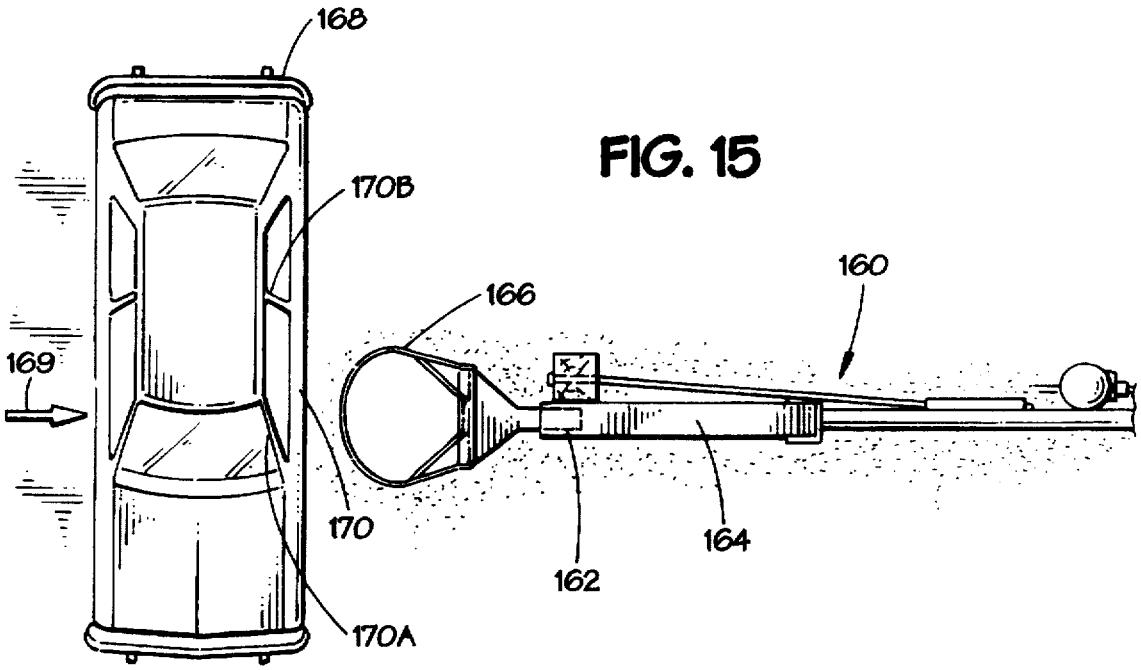
FIG. 15 is a plan view of an exemplary safety apparatus constructed in accordance with the present invention immediately prior to an end-on impact with the side of an approaching automobile.
Figure 16:
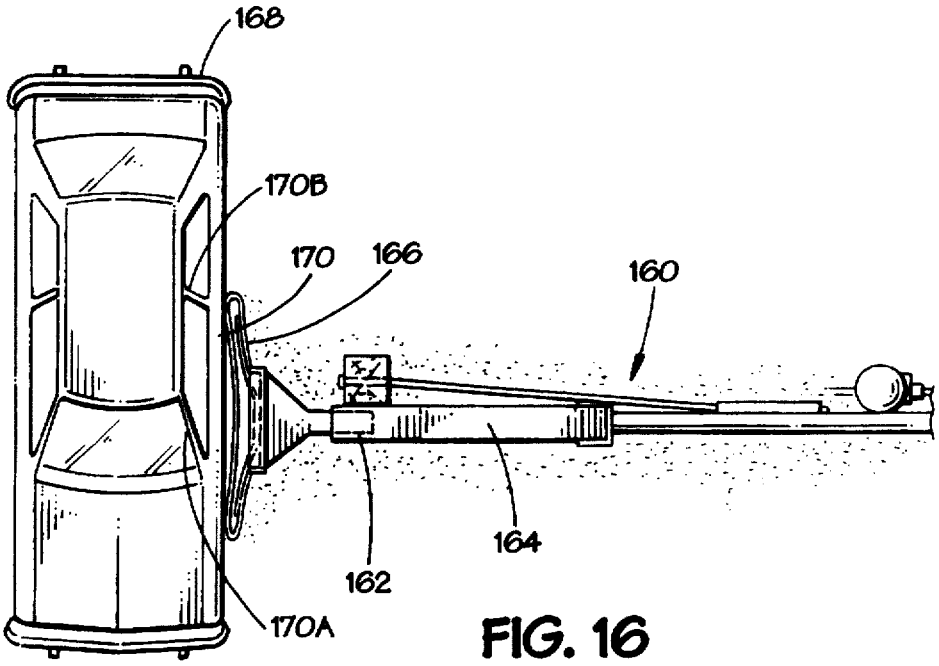
FIG. 16 is a plan view of the exemplary safety apparatus shown in FIG. 15 during the initial stages of impact with the automobile.

Now referring to FIGS. 15 and 16, operation of apparatus of the present invention is further illustrated. A guardrail assembly 160 is depicted which includes a safety apparatus 162 made up of an ET-2000 guardrail extruder terminal end treatment 164 and an affixed CPSI penetration guard 166. The penetration guard 166 shown is of the type described earlier and shown in FIGS. 1–5 and 10. However, any other suitable penetration guard embodiment may be used. In FIG. 15, an automobile 168 is shown approaching the guardrail assembly 160 in the general direction indicated by arrow 169 so as to result in an end-on impact to the guardrail assembly 160. Further, the automobile 168 is oriented such that the driver's side door 170 is facing the guardrail assembly 160 and makes a probable point of impact with the guardrail assembly 160. The driver's side door 170 is framed on either side by door pillars 170A and 170B.

FIG. 16 illustrates the automobile 168 and the guardrail assembly 160 during the initial portion of the impact between them. As the impact develops further (in a manner not described in detail herein), the extruder head will begin to flatten and bend portions of the guardrail. Further details concerning this aspect of the impact are described in U.S. Pat. No. 4,928,928, entitled "Guardrail Extruder Terminal," issued to Buth et al. on May 29, 1990, and U.S. Pat. No. 5,078,366, entitled "Guardrail Extruder Terminal," issued to Sicking et al. on Jan. 7, 1992 which have been incorporated herein by reference. As FIG. 16 shows, the penetration guard 166 is essentially flattened so that it presents an expanded width area as described previously.

Those skilled in the art will recognize that a CPSI penetration guard might also be affixed to other fixed roadway objects, such as telephone poles, lighting poles or breakaway supports to reduce the hazards associated with impact with them. While the invention has been herein shown and described in what is presently believed to be the most practical and preferred embodiment thereof, it will be apparent to those skilled in the art that many modifications may be made to the invention described while remaining within the scope of the claims.

What is claimed is:

1. A penetration guard for attachment to a guardrail end treatment to substantially reduce and spread initial impact load, the penetration guard comprising:

a cushioning frame adapted to be affixed to a guardrail end treatment, the frame having an outer housing defining a central opening;

the frame being greatly collapsible from a substantially end-on impact and being substantially non-collapsible during a non-end-on impact.

2. The penetration guard of claim 1 wherein the cushioning frame comprises a sheet metal shell and a supporting lateral brace piece located within the central opening.

3. The penetration guard of claim 1 further comprising means for attachment of the frame to a guardrail end treatment.

4. The penetration guard of claim 2 wherein the frame comprises a unitary section of sheet metal.

5. The penetration guard of claim 4 wherein portions of the sheet metal extend downwardly.

6. The penetration guard of claim 1 wherein the frame collapses during a vehicular impact to present an end-on impact area of expanded width, the width of said impact area being approximately four feet.

7. The penetration guard of claim 1 wherein the frame comprises a plurality of hinged plates.

8. The penetration guard of claim 1 wherein the frame comprises a plurality of corrugated panels.

9. The penetration guard of claim 8 further comprising a cross-brace.

10. The penetration guard of claim 1 further comprises a collapsible filler disposed within said central opening.

11. A safety apparatus for attachment to an end of a highway guardrail, the apparatus comprising:

a. a guardrail end treatment for reducing danger associated with an end-on impact with a guardrail; and b. a penetration guard for preventing penetration of portions of a vehicle by the guardrail end treatment.

12. The safety apparatus of claim 11 wherein the guardrail end treatment comprises a guardrail extruder terminal.

13. The safety apparatus of claim 11 wherein the guardrail end treatment comprises a breakaway cable terminal.

14. The safety apparatus of claim 11 wherein the guardrail end treatment comprises a modified eccentric loader terminal.

15. The safety apparatus of claim 11 wherein the guardrail end treatment comprises a slotted rail terminal.

16. The safety apparatus of claim 11 wherein the penetration guard comprises a cushioning frame affixed to a portion of the guardrail end treatment, the frame having an outer housing defining a central opening.

17. The safety apparatus of claim 12 wherein the penetration guard comprises a supporting lateral brace located within the central opening.

18. A guardrail assembly for placement alongside a roadway, the guardrail assembly comprising:

a. a guardrail;

b. a guardrail end treatment incorporated into one end of the guardrail for reducing the effects of vehicular impacts with the end of the guardrail; and c. a penetration guard for preventing penetration of portions of a vehicle by the guardrail end treatment.

19. The guardrail assembly of claim 18 wherein the guardrail end treatment comprises a guardrail extruder terminal.

20. The guardrail assembly of claim 18 wherein the penetration guard comprises a collapsible metal frame.

* * * * *